US007814904B2

(12) United States Patent
Resnick

(10) Patent No.: US 7,814,904 B2
(45) Date of Patent: Oct. 19, 2010

(54) PROTECTIVE HOOD STRUCTURAL ATTACHMENT SYSTEM

(75) Inventor: Todd A. Resnick, Stuart, FL (US)

(73) Assignee: TMR-E, LLC, Tampa, FL (US)

( * ) Notice: Subject to any disclaimer, the term of this patent is extended or adjusted under 35 U.S.C. 154(b) by 990 days.

(21) Appl. No.: 11/556,422

(22) Filed: Nov. 3, 2006

(65) Prior Publication Data

US 2008/0105255 A1 May 8, 2008

(51) Int. Cl.

| | |
|---|---|
| ***A62B 17/04*** | (2006.01) |
| ***A62B 18/00*** | (2006.01) |
| ***A62B 7/10*** | (2006.01) |
| ***A62B 19/00*** | (2006.01) |
| ***A62B 23/02*** | (2006.01) |

(52) U.S. Cl. ..... 128/201.22; 125/201.25

(58) Field of Classification Search ..... 128/201.22–201.25, 201.29, 205.27–205.29, 128/206.15–206.17; 2/171, 8.2, 410, 422, 2/457

See application file for complete search history.

(56) References Cited

U.S. PATENT DOCUMENTS

| | | | | | |
|---|---|---|---|---|---|
| 3,789,839 | A | * | 2/1974 | Lund et al. | 128/201.25 |
| 4,231,118 | A | * | 11/1980 | Nakagawa | 2/7 |
| 5,452,712 | A | * | 9/1995 | Richardson | 128/201.25 |
| 5,875,775 | A | * | 3/1999 | Nur et al. | 128/201.28 |
| 6,158,429 | A | * | 12/2000 | Gardner et al. | 128/201.25 |

* cited by examiner

*Primary Examiner*—Justine R Yu
*Assistant Examiner*—Kristen C Matter
(74) *Attorney, Agent, or Firm*—Design IP

(57) ABSTRACT

The present invention is a flexible respiratory protective hood having interior and exterior surfaces. Multiple apertures are die-cut in the hood in a predetermined geometric configuration. A substantially rigid respiration component to provides a fluid pathway between hood interior and exterior. Raised fluid ports extend from the respiration component and are aligned with the apertures. Fluid ports extend from the hood interior surface and project from the hood exterior surface. A bond between the hood interior surface and the respiration component form a fluid impermeable seal between the respiration component and hood.

9 Claims, 7 Drawing Sheets

PROTECTIVE HOOD STRUCTURAL ATTACHMENT SYSTEM

FIELD OF INVENTION

This invention relates to protective respiratory devices, and more particularly, to affixing substantially rigid structures to a flexible hood.

BACKGROUND OF THE INVENTION

Respiratory protective devices are centuries old and used for the prime objective of protecting the body from airborne pollutants and toxic materials. A relatively new design in the field is the compact, disposable respiratory protective hood. Unlike reusable, bulky and expensive masks having replaceable filters, respiratory protective hoods are designed to be highly compact, effective and adapted for one-time use.

Respiratory protective hoods generally cover the head of a person and seal about the neck perimeter. The hood is constructed of a fluid impermeable material and a flexible, transparent integrated visor is affixed about the front of the hood to permit outward vision by the wearer. Inhaled air is filtered for contaminants and exhaled air is discharged from the hood. Applicant's earlier U.S. Pat. Nos. 6,301,103; 6,371,116; 6,701,925; 6,736,137; 6,817,358; 6,907,878; 7,114,496; and co-pending patent application Ser. Nos. 11/539,960 and 11/551,068 provide substantial background discussions on the state of respiratory protective hood design, all of which are incorporated by reference.

A common use for respiratory protective hoods is deployment in unexpected, emergency situations such as terrorist attacks. By its very nature, terrorist attacks are generally executed without warning to the intended victims. Military, police and civilian personnel have little or no notice prior to an attack. These attacks may include the disbursement of nuclear, biological and/or chemical agents with the intent to kill or injure military and/or civilian populations. Accordingly, it is generally not feasible to carry large, protective devices around at all times. A balance must be struck against the real need to have effective protective gear versus the logistics of carrying the protection around on a day-to-day basis.

A solution has been to vacuum pack the respiratory protective hood in a compact form. Packaged units are sealed until they are needed. The outer packaging is opened and the hood is then unfolded deployed. An important objective in many respiratory hood designs is minimizing the package size and weight. This enhances storage and portability of the device and thus directly relates to the device's availability when it is required.

Yet another consideration is cost of materials and assembly. Bonding rigid structures such as filters to a flexible hood is expensive and complicated. Traditional gas masks have threaded couplings upon which a filter is screwed to form a substantially fluid-tight compression fit against the hood surface. Unfortunately, threads are not always reliable. Threads, if struck by a hard object or dropped may be damaged and thereby form a leak path compromising the protection factor of the apparatus. Furthermore, threads may loosen, again providing a leak path and comprising efficacy. Threaded couplings also add weight and create bulk. Furthermore, funnels for providing the fluid path create even more bulk and increase breathing resistance. An alternative design to the threaded coupling is ultrasonically welding or bonding flanges around a substantially rigid respiratory component. However, these flanges occupy space, add weight and increase the cost of the device. In addition, as flanges increase in size to provide a better mount, the corresponding respiratory component must be reduced in size. Other fittings may include a simple interference fit which may loosen. Yet another fitting may include bayonet fittings. A shortcoming of these attachment methods is that they do not provide the security of a permanent, fluid-tight attachment.

Some respiratory hood designs have attempted to integrate and/or bond flexible filters assemblies directly to the hood. However, none of these designs provide the protection factor and reliability of a filter assembly packed in a substantially rigid housing.

There is a long-felt but unfulfilled need in the art for a flexible respiratory protective hood that has substantially rigid respiratory components such as filters bonded directly to the hood material without the bulk, expensive or other comprises associated with threaded couplings or flanges.

SUMMARY OF INVENTION

The present invention is a flexible respiratory protective hood having a unique system for affixing rigid respiratory components to the flexible hood. At least one aperture in the hood is die-cut in a predetermined geometric configuration. A substantially rigid respiration component provides a fluid pathway between the exterior and interior of the hood. The respiration component may include, but is not limited to, air-purifying filters, check valve interfaces, purge zones, drink tube interfaces and speaking diaphragms. At least one fluid port opening in the respiration component is arranged in aligned relation to the aperture whereby a portion of the hood abuts the respiration component coincident to the port. A bond is established between the hood and respiration component thereby forming a fluid impermeable seal between the respiration component and the hood.

In an embodiment of the invention, a plurality of apertures and an equal plurality of fluid ports are aligned prior to bonding. The apertures and corresponding fluid ports may be substantially equidistant from each other thereby forming a grid-like pattern. The bond may include, but is not limited, to direct thermal fusion, thermally activated adhesive and solvent fusion. In direct thermal fusion, the hood material is fused directly to the rigid respiratory component. This method does not use any type of heat-activated adhesive. Thermally activated adhesive generally starts as a thin, dry film sandwiched between the hood material and the rigid hood structure. In solvent fusion, hood material is fused to a rigid component by means of chemical solvent. The solvent temporarily softens the two materials.

The thermally activated adhesive film is die-cut independently of the hood aperture. Although the respiratory component may be affixed to the exterior of the hood, in most cases, the component will be bonded to the interior surface of the hood.

In another embodiment of the invention, the fluid ports are raised whereby they extend from the respiration component. The fluid ports are received by corresponding apertures and project through the hood whereby a portion of the hood abuts the respiration component between raised fluid ports.

An advantage of the present invention is that both a fluid and mechanical coupling is achieved simultaneously through the direct bonding system.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
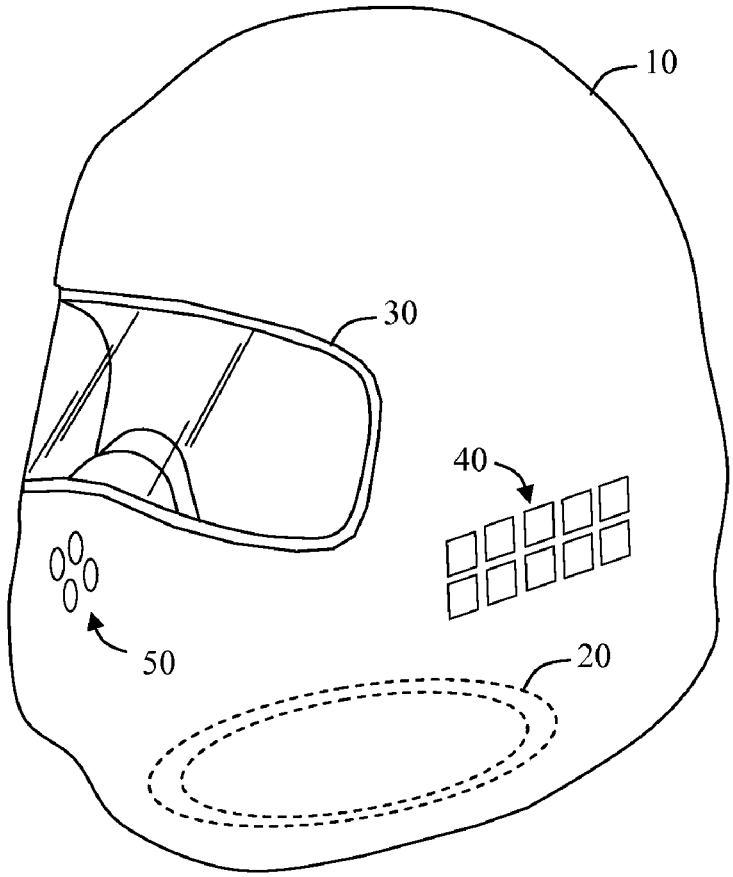
FIG. 1 is a partially sectional, isometric view of a partial hood assembly showing die-cut apertures formed in the hood surface.

Turning to FIG. 1, hood 10 receives the head of a wearer through neck opening 20 and is substantially fluid impermeable. The hood may be constructed of numerous materials including, but not limited to, composite chemical protective fabrics, polyimide film, polyvinyl chloride (PVC), urethane, butyl coated fabric, neoprene (dipped), and butyl (dipped).

Visor 30 provides outward vision. Filter component apertures 40 are die-cut or otherwise formed in hood 10 on lateral sides. Exhalation component apertures 50 are also die-cut or otherwise formed in hood 10 below visor 30. It should be noted that the location, shape and quantity of the apertures may varying according to the needs and preferences of the design while still within the scope of the present invention. While a single aperture is anticipated in the present invention, an embodiment of the invention provides for a plurality of apertures arranged substantially equidistant from each other. The interstitial space between the apertures provides additional surface area for bonding thereby establishing a stronger overall bond between the hood and the respiration component.

Figure 2:
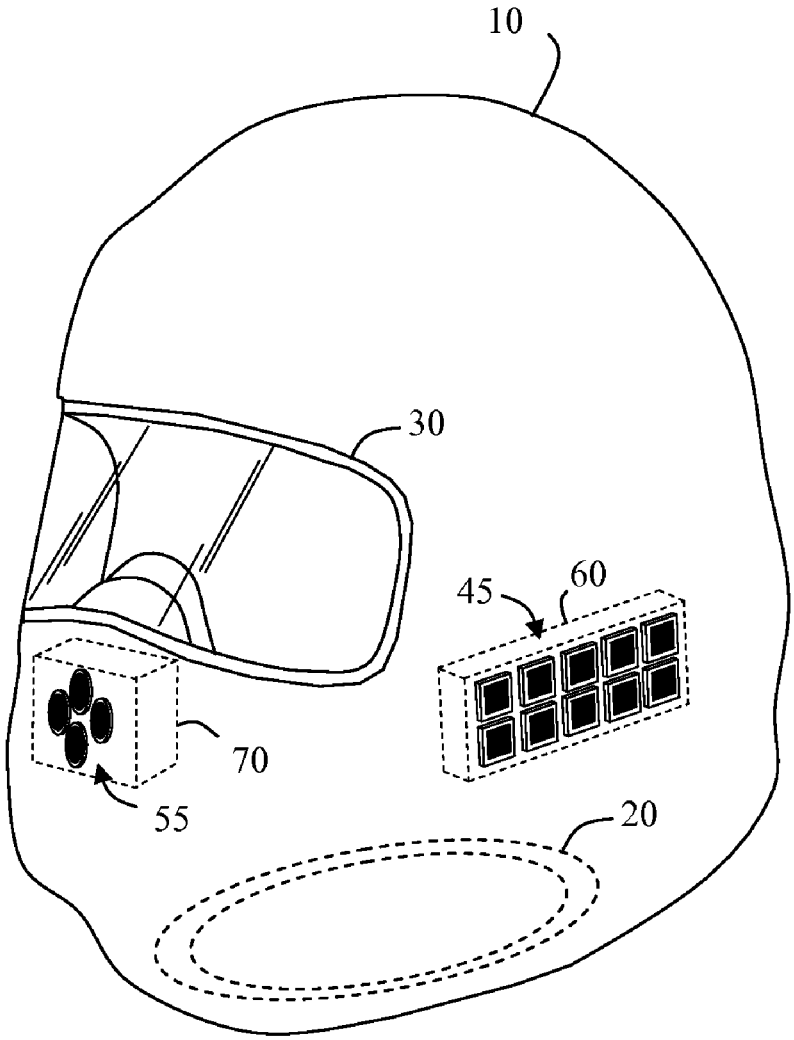
FIG. 2 is a partially sectional, isometric view of a completed hood assembly showing respiratory components bonded to the interior of the hood with raised fluid ports extended outward from the hood interior.

In FIG. 2, inhalation filter component 60 has a plurality of raised fluid ports 45 which correspond to apertures 40 (now hidden by fluid ports 45). Similarly, exhalation component 70 has a plurality of raised fluid ports 55 which correspond to apertures 50 (now hidden by fluid ports 55). It should be noted that the fluid ports may be either raised or flush with the surface of the respiration component. An advantage of raising the fluid ports is to facilitate assembly as the fluid ports self-align with the apertures. In addition, the raised fluid ports provide additional mechanical resistance against lateral movement of the respiration component.

Figure 3:
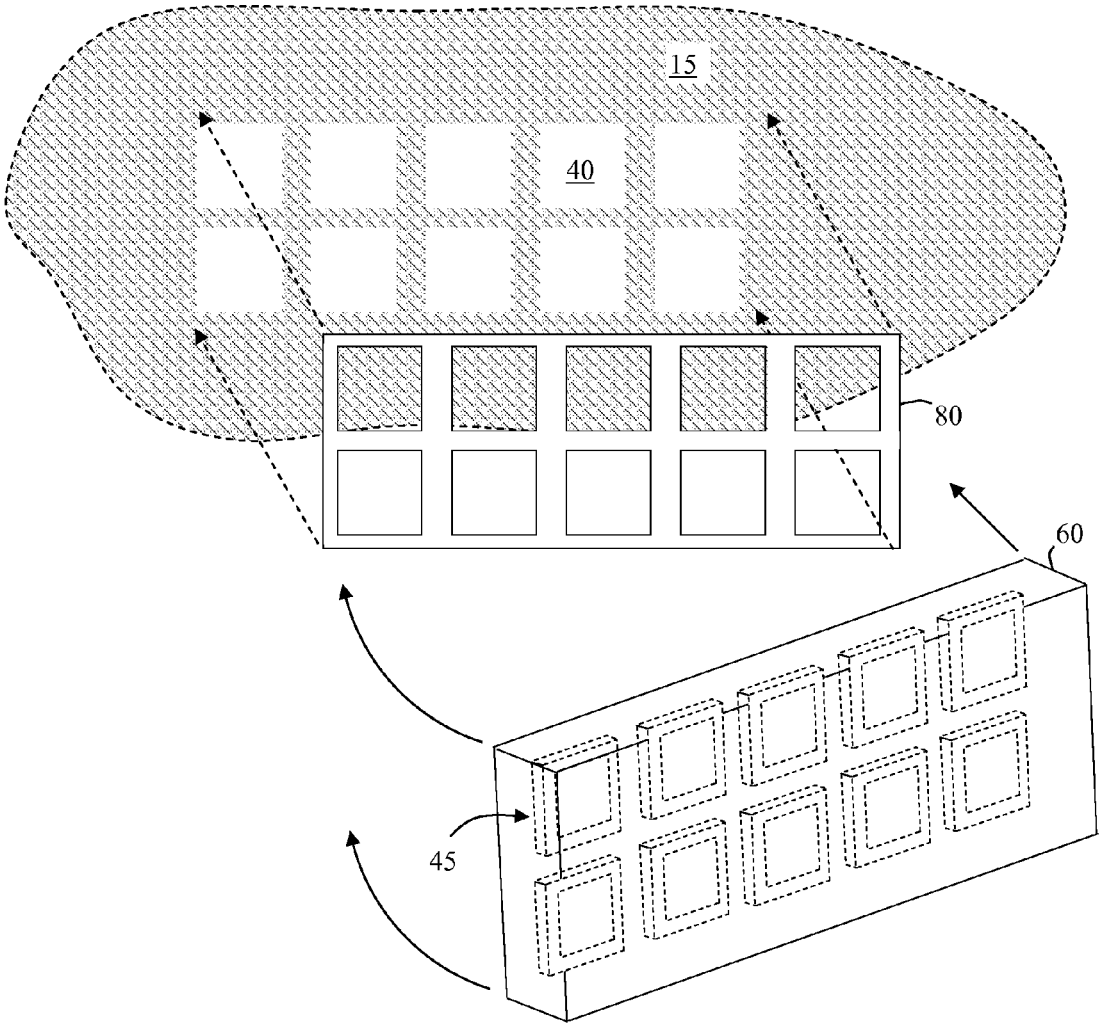
FIG. 3 is a partially sectional, exploded isometric view of a filter cartridge bonded to a hood surface by a thermally activated adhesive die-cut to match hood apertures.

In FIG. 3, a plurality of apertures 40 are die-cut into hood interior surface 15 and thermally activated adhesive film 80. Adhesive film 80 and hood surface 15 are exploded for illustrative purposes. Inhalation filter component 60 has a plurality of raised fluid ports 45. Adhesive film 80 is sandwiched between hood interior surface 15 and inhalation filter component.

Figure 4:
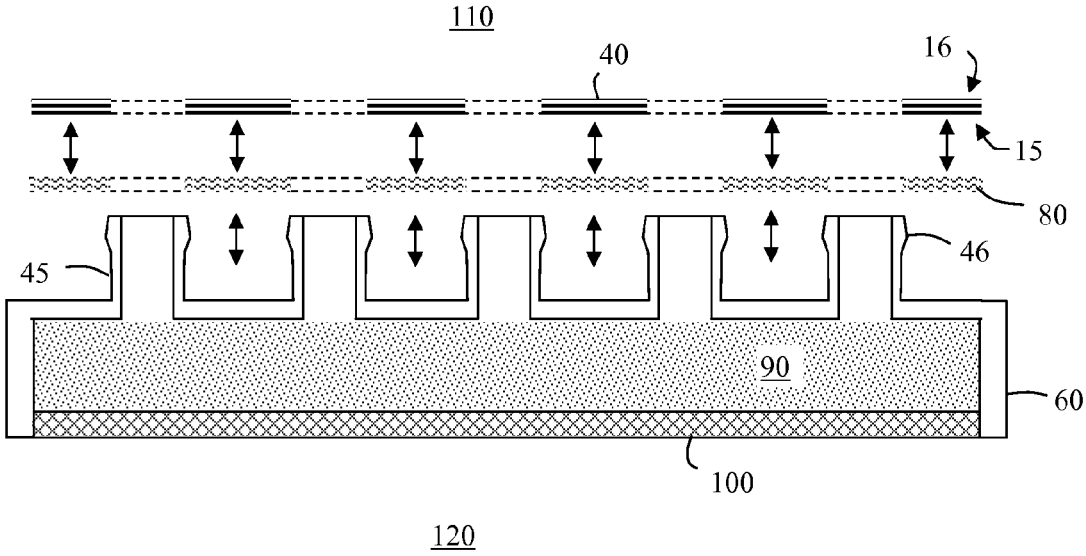
FIG. 4 is an elevated, partially sectional view of a filter cartridge bonded to a hood surface by thermally activated adhesive die-cut to match hood apertures.

FIG. 4 illustrates the bonding of filter component 60 to hood 40 interior surface 15 with thermally activated adhesive film 80. Hood interior 120, hood exterior 110 and hood exterior surface 16 are noted for reference. Optional chamfer 46 extends about the axis of raised fluid port 45 whereby during assembly, chamfer 46 provides limited mechanical resistance against adhesive film 80 and hood 40 from lifting off filter component 60. Filter component 60 includes filtration media 90 adapted to remove nuclear, chemical and/or biological matter from ambient air drawn in through raised fluid port 45. Because filter component 60 is mechanically bonded to hood 40 and not necessarily to other respiratory components, it is possible for filtered air to pass through large filtration passage 100 into hood interior 120. This dramatically reduces breathing resistance and thus enhances overall usability and comfort.

Figure 5A:
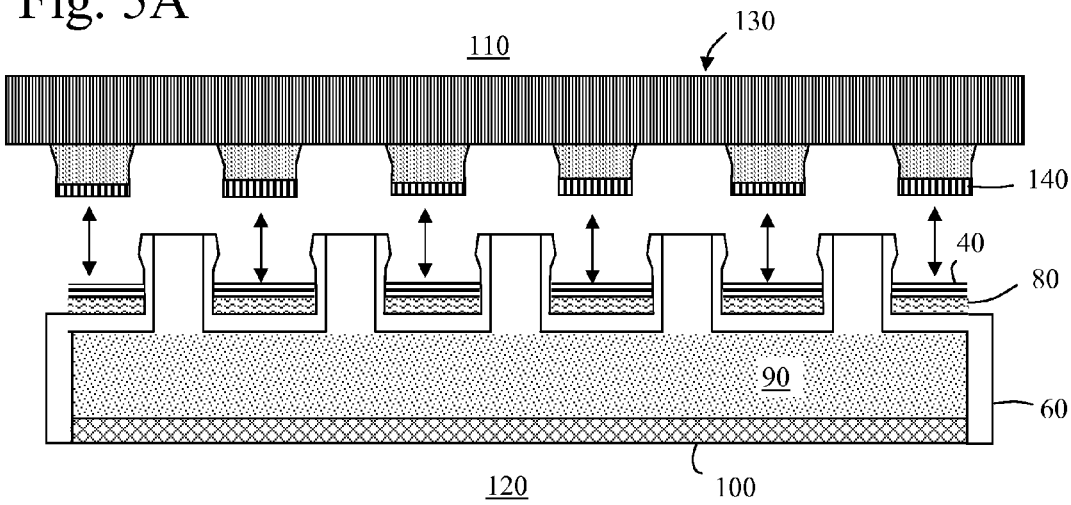
FIG. 5A-B are partially sectional, elevated views of a filter cartridge being bonded to a hood by thermally activated adhesive with a heating element.
Figure 5B:
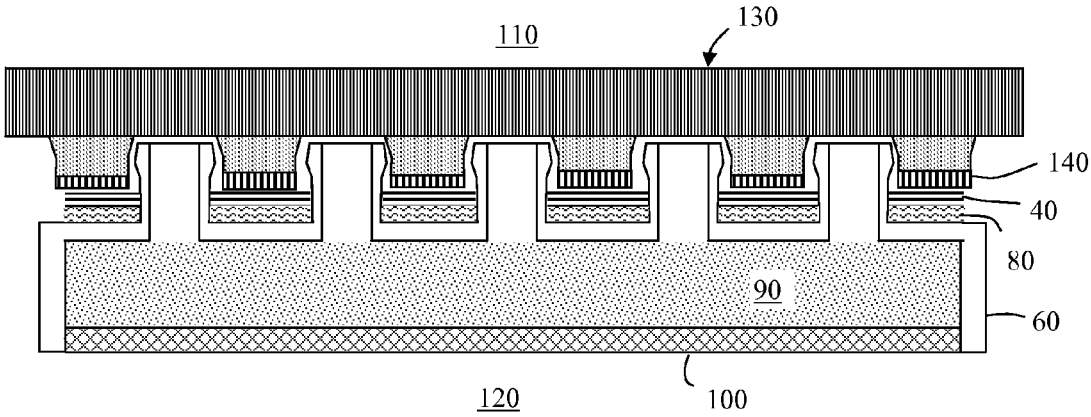

In FIGS. 5A-B heating apparatus 130 aligns heating surface 140 in an inverted pattern from apertures 40 whereby heat activates thermally activated adhesive film 80 to bond hood 40 to filter component 60. The respiratory components are attached to the hood after the hood face pattern has been die cut and before the hood face pattern is formed into a hood. The respiratory component is placed in a fixture. The die cut thermal adhesive is placed onto the respiratory component and then the hood face pattern is placed onto the die cut thermal adhesive. A heated platen, which has been designed to mate with the respiratory component, is pressed down onto the hood face pattern in order to apply heat and pressure for a measured amount of time.

Figure 6:
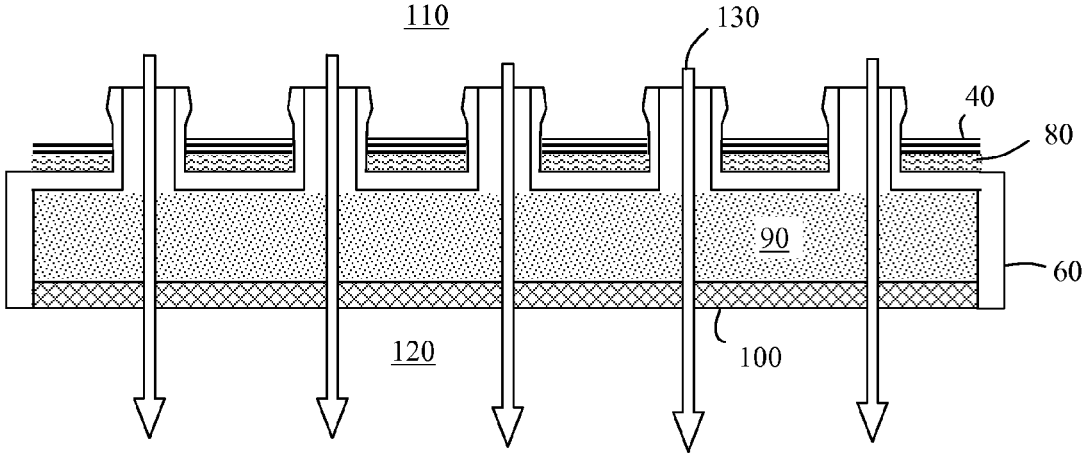
FIG. 6 is a partially sectional, elevated view of the fluid path of an inhalation filtration component bonded to the hood interior surface by thermally activated adhesive.
Figure 7:
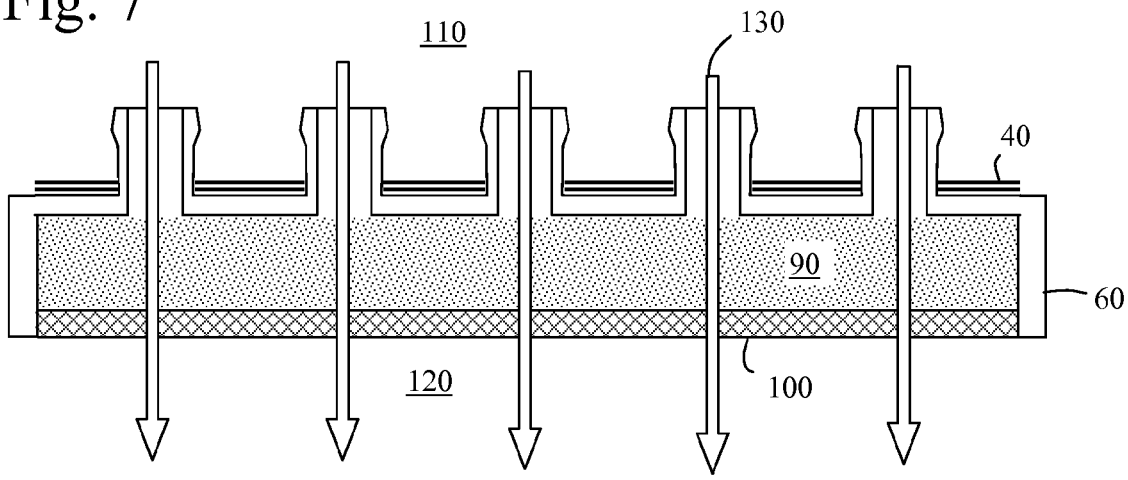
FIG. 7 is a partially sectional, elevated view of the fluid path of an inhalation filtration component bonded to the hood surface by direct thermal bonding.

FIGS. 6-7 show fluid-flow 150 through filter component 60 bonded to hood 40. FIG. 6 illustrates a bond using thermally activated adhesive 80 while FIG. 7 illustrates a bond using direct thermal bonding of hood 80 to filter component 60.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A flexible respiratory protective hood having interior and exterior surfaces;

a plurality of apertures in the hood die-cut in a predetermined geometric configuration;

a substantially rigid respiration component adapted to provide a fluid pathway between a hood interior and exterior; and a plurality of raised fluid port openings in the respiration component projecting through and aligned to the plurality of apertures whereby surface area on the hood between the plurality of apertures is permanently bonded with corresponding surface area on the respiration component between the plurality of raised fluid port openings thereby forming a fluid impermeable seal between the respiration component and hood.

2. The hood of claim 1 wherein the respiration component is selected from the group consisting of air-purifying filters for inhalation, check valves, purge zones, drink tube interfaces, and speaking diaphragms.

3. The hood of claim 1 wherein the apertures and aligned fluid ports are substantially equidistant from each other thereby forming a grid.

4. The hood of claim 1 wherein the bond is selected from the group consisting of direct thermal fusion, thermal adhesive and solvent fusion.

5. The hood of claim 1 wherein the bond is a thermally activated adhesive film.

6. The hood of claim 1 wherein the bond is made between the respiration component and the interior surface of the hood.

7. The hood of claim 1 wherein the raised fluid port openings further comprise chamfers extending about the axis of each raised fluid port opening.

8. A flexible respiratory protective hood having interior and exterior surfaces;

a plurality of apertures in the hood die-cut in a predetermined geometric configuration;

a substantially rigid respiration component adapted to provide a fluid pathway between a hood interior and exterior, the respiration component is selected from the group consisting of air-purifying filters for inhalation, check valves, purge zones, drink tube interfaces, and speaking diaphragms; and a plurality of substantially equidistantly spaced raised fluid port openings in the respiration component projecting through and aligned to the plurality of apertures whereby portions of the hood between the plurality of apertures are permanently bonded with portions of the respiration component between the plurality of raised fluid port openings thereby forming a fluid impermeable seal between the respiration component and hood, the bond selected from the group consisting of direct thermal fusion, thermal adhesive and solvent fusion.

9. A flexible respiratory protective hood having interior and exterior surfaces;

a plurality of apertures in the hood die-cut in a predetermined geometric configuration;

a substantially rigid inhalation filter component adapted to provide a fluid pathway between a hood interior and exterior; and a plurality of raised fluid port openings in the filter component projecting through and aligned to the plurality of apertures whereby surface area on the hood between the plurality of apertures is permanently bonded with corresponding surface area on the inhalation filter component between the plurality of raised fluid port openings thereby forming a fluid impermeable seal between the inhalation filter component and hood.

* * * * *